United States Patent [19]
Grace et al.
[11] 4,320,912
[45] Mar. 23, 1982

[54] COWL DOOR LATCH ADJUSTMENT FITTING ASSEMBLY

[75] Inventors: Thad N. Grace, Chula Vista; Carroll W. Folmer, San Diego; Douglas W. Logan, Spring Valley, all of Calif.

[73] Assignee: Rohr Industries, Inc., Chula Vista, Calif.

[21] Appl. No.: 73,706

[22] Filed: Sep. 10, 1979

[51] Int. Cl.[3] ..... E05C 21/00
[52] U.S. Cl. ..... 292/341.18
[58] Field of Search ..... 292/114, 247, 341.18, 292/DIG. 31

[56] References Cited

U.S. PATENT DOCUMENTS 3,129,025 4/1964 Krueger ..... 292/113 X
4,183,564 1/1980 Pol ..... 292/DIG. 31

*Primary Examiner*—Richard E. Moore
*Attorney, Agent, or Firm*—Patrick J. Schlesinger; Frank D. Gilliam

[57] ABSTRACT

An adjustable, flush mounted over center hook-latch assembly of the general type employed to secure abutting aircraft panels in flight ready condition. The device, the tension on the internal hook and eye structure, is adjustable from the external surface of the aircraft skin. Precision alignment pins and apertures cooperating therewith provide for proper alignment of the two abutting panel structures prior to their latched flight ready condition.

2 Claims, 7 Drawing Figures

COWL DOOR LATCH ADJUSTMENT FITTING ASSEMBLY

BACKGROUND OF THE INVENTION

This invention relates to hook-latch assemblies, and more specifically, to an adjustable, flush mounted, over center, hook-latch assembly of the general type used to secure abutting aircraft panels in place.

Over center, hook-latches are well known in this art. Examples can be found in U.S. Pat. Nos. 2,712,955; 2,695,803; 2,904,141, and 2,800,346. As can be readily seen, in these U.S. Patents, as well as undoubtedly in others, the fulcrum axis of the latch handle is mounted to a bracket aircraft structural panel, and the latch-hook engages a keeper on the abutting panel. When the latch handle is in its stowed position, adjacent the mounting service, and flush with the outer skin of the aircraft, the load on the latch hook creates a lever arm on the latch handle about the fulcrum axis in the direction which maintains the latch handle in its closed position. The distance between the latch hook and the keeper is critical and must be maintained at a proper torque setting. If the distance is too great, the latch will not close or will create excessive stress forces on the aircraft components causing possible damage on them as well as the hook-latch assembly. If, on the other hand, the distance is too close, the hook will not engage the keeper with sufficient tension to maintain the panels in abutting engagement, while in flight. The hook-latch assembly must include some type of adjusting means on the assembly to accurately adjust the hook relative to the keeper for their initial installation, and subsequently when stress to the aircraft structure, may change the relative positions of the hook and keeper.

Generally, prior art adjusting means required that the latch be released to adjust the relative position of the latch and keeper. Because proper adjustment could only be established when the latch and keeper are engaged, trial and error adjustment is necessitated. This becomes a time consuming task when a plurality of latches are utilized to abutt various aircraft structures, because of the numbers and possible interaction between the various fasteners on any pair of abutting surfaces.

Other prior art fasteners of this type, could only be adjusted from the under, or unexposed side of the aircraft abutting panels; requiring that the panels be removed, adjusted and then replaced time and again to provide proper tension or torque to a plurality of hook-latch combinations on one pair of abutting aircraft assemblies.

Other prior art fasteners, which could be adjusted while the latch was secured to the keeper from the outside, provided for moving or adjusting the latch arm pivot axis relative to the fulcrum axis of the latch handle. This required adjacent elongated slots extending in different directions which receive the pivot or fulcrum pin and a pair of yoke members for locating and securing the pivot pin within the slots, at a preselected vertical or horizontal position. This type of prior art fasteners is suscepticle to wear on the slot and connecting surfaces. The position of the pin is controlled by a single center positioned screw, which can cause the assembly to wobble at certain aircraft vibration frequencies, increasing the wear and reducing reliability of the fastener system. No means is provided in this type of fastening system for maintaining proper alignment of the abutting panels when latch wear is encountered causing relative side movement between the keeper and latch and considerable numbers of components are required to provide this type of assembly. In addition, this type of assembly is very susceptible to failure, due to the large number of active parts used in its construction.

SUMMARY OF THE INVENTION

Therefore, is an object of this invention to provide a flush mounted hook-latch assembly, which can be readily and easily adjusted after the latch is secured to the hook, without releasing the hook from the latch.

Another object of this invention is to provide an over center, flush mounted hook-latch which may be adjusted without affecting the over center locking characteristics of the assembly.

Still another object of this invention is to provide a flush mounted hook-latch which may be easily and accurately adjusted by a conventional open end spanner wrench through a slot or opening through the external surface of the abutting structures opposite the hook-latch mechanism while the abutting materials are joined by their appropriate hook and latch combinations.

A further object of this invention, is to provide positive alignment of the abutting structures prior to their being latched together in a flight ready condition. A further object is to provide a flush mounted hook-latch assembly which is economical and easy to manufacture.

Other and further objects of this invention will appear from the following description:

In accordance with these objects, the invention comprises an over center, adjustable, flush mounted hook-latch assembly capable of being adjusted after the abutting aircraft structures are installed and secured on the aircraft. The hook or keeper is adjustable relative to the latch by longitudinal adjustment of its connection to one of the abutting aircraft structures. This is accomplished by providing an opening through the attached material, remote from the latch mount, through which an adjustment nut can be turned with a conventional open end spanner wrench. The spanner wrench, when attached to an appropriate torque measuring device, can measure the tension on the hook-latch assembly. A resilient spring is provided to maintain constant longitudinal pressure against the latch adjustment jam nut and mounting structure, while the abutting panels are joined and fine adjustments are being made. A precision aperture is provided on one of the two abutting materials that mates with a corresponding precision tapered pin on the other abutting material to insure that an exact alignment or relative positions of the two materials is accomplished prior to their being latched together in a flight ready condition.

The invention, accordingly, comprises the features of construction, combination of elements, and arrangements of parts, which will be exemplified in the construction hereinafter set forth, and the scope of the invention will be indicated in the claims.

BRIEF DESCRIPTION OF THE DRAWINGS

For further understanding of the nature and objects of this invention, reference should be made to the following detailed description taken in connection with the accompanying drawings, in which.

The same reference numerals will be used throughout the application to denote the identical part or element.

DESCRIPTION OF THE PREFERRED EMBODIMENT

Figure 6:
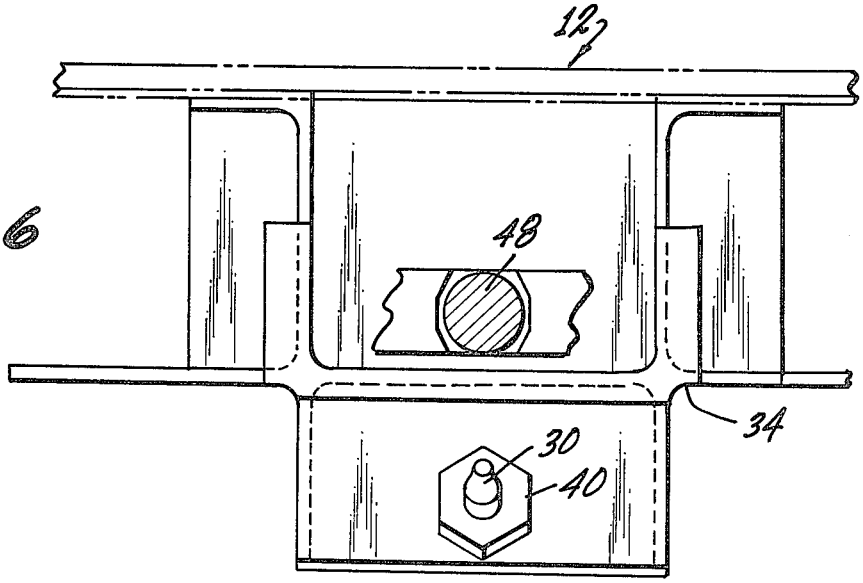
FIG. 6 is a showing of FIG. 2, taken along lines 6—6 of FIG. 2.

Referring now to FIGS. 1, 2, 2*a* and 3, these figures show a portion of the two sections 10,12 of the aircraft cowl or nacelle sections, that are removably joined by the hook-latch assembly 14 of the instant invention. The hook-latch assembly 14 includes a pawl tension latch 16, one end of the pawl tension latch is pivotally attached to a latch handle 18 at pivot point 20 adjacent the handle pivot point 22. The latch handle 18 is shown pivotally attached to the aircraft cowl or nacelle section 12. When the latch handle 18 is lifted at its outer end 24, and pivoted outwardly, along arrow 26, the pawl tension latch 16 pivots and accordingly, translates along arrow 28, toward the adjacent cowl or nacelle section 10. Tapered guide pins 30 (one shown) are secured to the surface of inner wall 32, of the aircraft cowl or nacelle section 12 and which is part of bracket 34. These guide pins 30 are directed at an angle toward the opposite cowl or nacelle section 10 for mating with aperture 36 therein. The guide pins 30 of the preferred embodiment threadedly engage wall 32 of the bracket 34 and are locked in a selected longitudinal position by a locking nut 37. The apertures 38 of wall 32 are either internally threaded or are smooth with a nut 40, such as that shown in FIGS. 2 and 2*a*, fixedly secured to the wall 32 of bracket 34 by any conventional means, such as welding as an example. Each guide pin 30 mates with an aperture 36 in the opposite abutting panel, as hereinafter described in more detail for properly aligning the two joined, abutting structures 10,12. FIG. 6 clearly shows the wall 32 of bracket 34, the outer end of the guide pin 30 and the attached threaded nut 40, as used in the preferred embodiment.

It should be understood that precision mating of the abutting panels or nacelle sections 10,12 is accomplished by the close tolerance of tapered pins 30 and their opposite engaging precision apertures 36. It should be further understood that apertures 36 and pins 30 may alternately be located on one or the other of the abutting panels or nacelle sections 10,12 for example, the apertures 36 could be provided in bracket 44 or bracket 34 and the pin 30 could be carried by bracket 34 or 44. Which panel carries the pin or aperture is not critical to the mating of the abutting panels.

Figure 1:
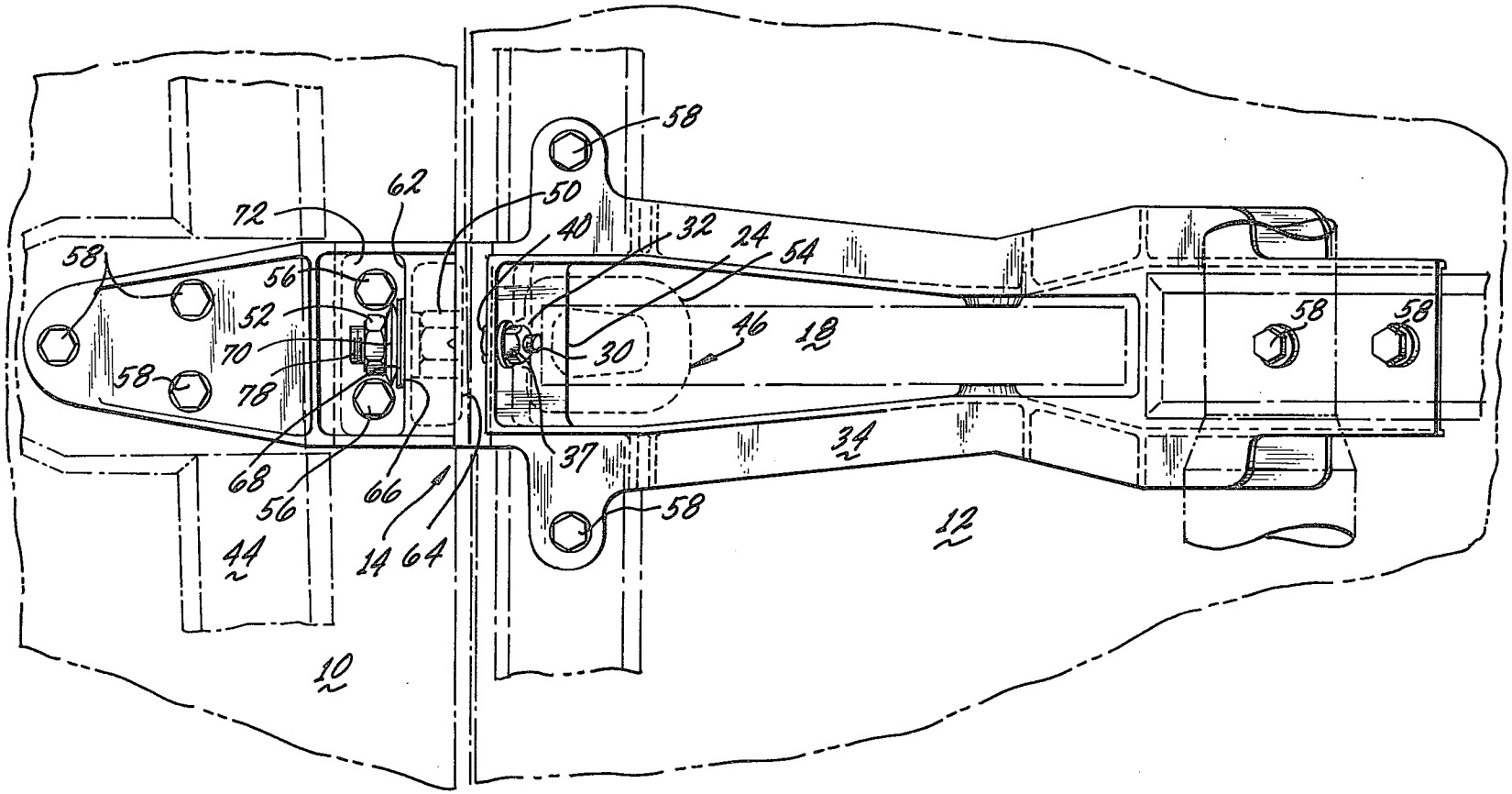
FIG. 1 is a bottom plan view of the hook-latch assembly and a section of each of the structures to be joined, the hook-latch assembly is shown in its secured or latched position.
Figure 2:
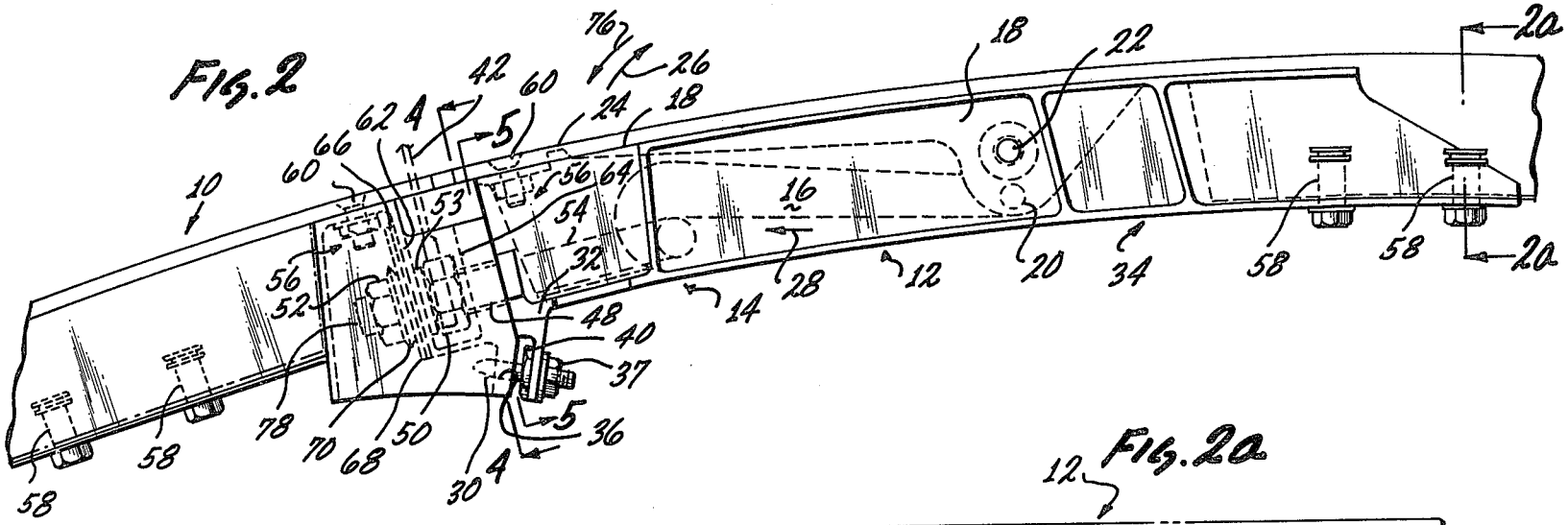
FIG. 2 is a side view of the FIG. 1 showing.
Figure 2A:
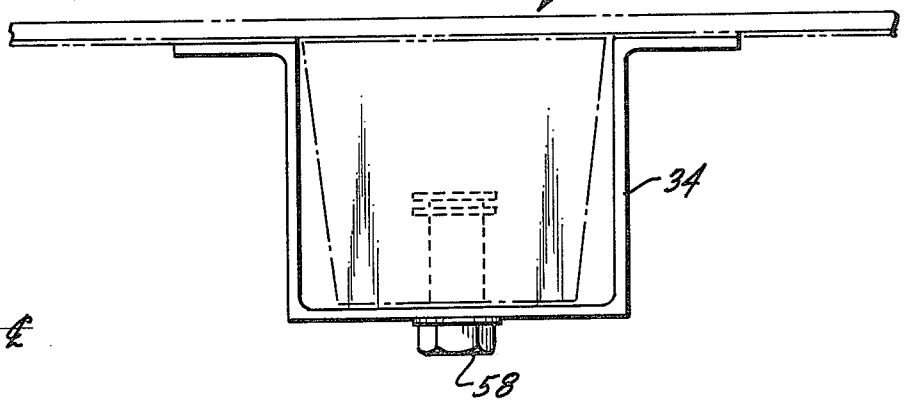
FIG. 2*a* is an end view of FIG. 2 taken along line 2*a*—2*a*.
Figure 4:
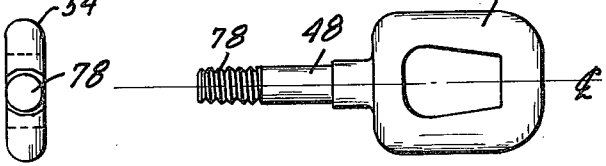
FIG. 4 is a plan view of the latch eye bolt of FIG. 1.
Figure 3:
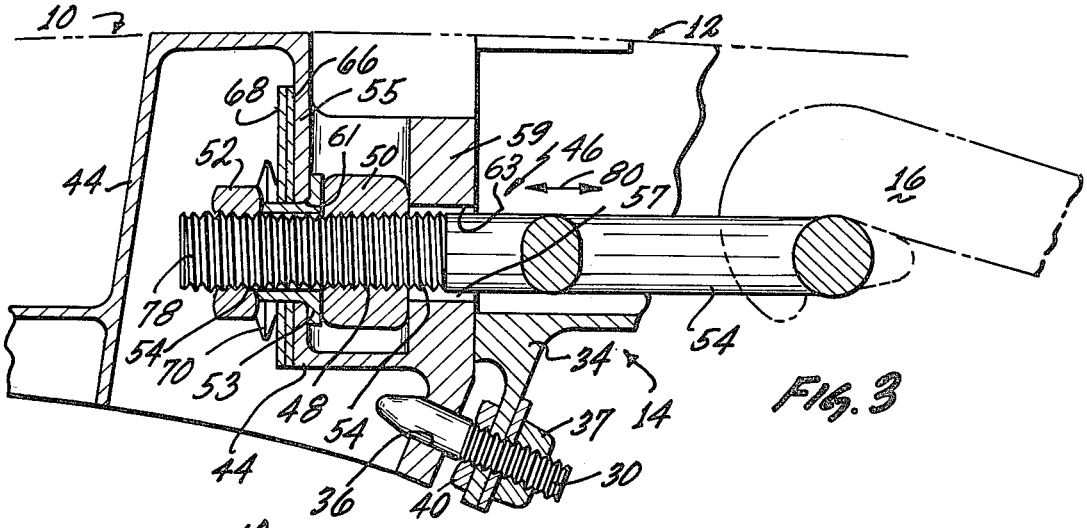
FIG. 3 is a showing of FIG. 2 taken along line 3—3 of FIG. 2.

A latch eye bolt 46, shown clearly in FIGS. 1 through 4, includes a shank portion 48 that is threaded to engage with a threaded adjusting nut 50 and a jam nut 52, and an eye portion 54 on the opposite end thereof. The bracket 44 is carried by the cowl or nacelle portion 10, for abutting the opposite cowl or nacelle portion 12. This bracket 44 carries either the aperture 36 or pin 30 for alignment of the two abutting sections, as hereinbefore discussed in detail. The shank portion 48 of the latch eye bolt 46 slidedly engages bushing 53 inserted through the aperture 61 in wall 55 and bushing 57 through aperture 63 in wall 59 of bracket 44. The shank portion 48 of the latch eye bolt 46 is shown as curvilinear throughout the various figures. It should be understood that any other peripheral configuration may be utilized to practice the invention equally as well. The bracket 44 like bracket 34 may be attached to the inner surface of the cowl or nacelle section by any convenient means, such as, but not limited to welding, brazing, bolting, etc., or any combination thereof. FIGS. 2 and 2*a* depict a combination of welding and bolting by bolt and nut combinations 56 and 58, the head 60 of the bolt 56 being countersunk to maintain a smooth aerodynamic outer contour surface of the cowl or nacelle section.

Positioned between walls 62 and 64 of bracket 44, is the adjusting nut 50, while the exterior of wall 62 includes a pair of abutting serrated plates 66,68 a spring washer 70, and the aforementioned jam nut 52. The adjusting nut 50 is exposed through an opening 72 in the outer skin 74 of the cowl or nacelle section carrying bracket 44. Serrated plate 66 is fixedly secured to wall 62 by any convenient means, while serrated plate 68 has freedom of movement with respect to wall 62 and the shank 48 of the latch eye bolt 46.

OPERATION OF THE PREFERRED EMBODIMENT

Prior to the abutting attachment of the adjacent cowl or nacelle sections, the jam nut 52 is adjusted to the approximate length required for inserting the tension latch 16 within the eye 54 of the latch eye bolt 46. The sections are then abutted by inserting the numerous pins 30 into their associated alignment aperture 36. While the sections are held together, manually or otherwise, each latch handle now in an outwardly or unlatched position is progressively closed by moving the outer end along arrows 76 to a skin flush condition (see FIG. 2). Any of the latch eye bolt eyes 54 that will not mate with their associated tension latches 16, a condition caused by the jam nut 52 positioned to far remote from the bolt end 78, are noted and the cowl or nacelle sections 10,12 are then demated and the lock jam nuts and the adjusting nuts are moved toward the end 78 of the latch eye bolt 46 remote from the eye end 54, the mating process will be repeated until all tension latches mate within the eye of their associated latch eye bolt. When this procedure is complete, the latch eye bolts are then adjusted by means of the adjusting nut 50 for proper tension on wrench 42, utilized for adjustment (torque values are preestablished for tightening of the latch), while the latch handles are in a closed or skin flush condition.

After all of the torque adjustments are made, the panels or nacelle sections are again demounted and the jam nuts are then torqued to predetermined values. It should be noted, that the serrated plates and the spring washer hold the latch eye bolt in place until the final jam nut torquing is complete. It should be further noted that later adjustments in the directions of arrow 80 can be made through the range of displacement allowed by the tension of the spring washer 70.

Figure 5:
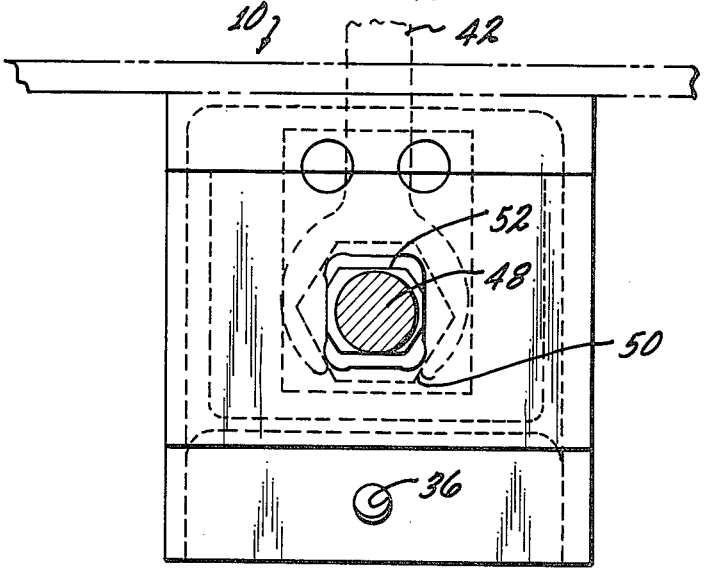
FIG. 5 is a showing of FIG. 2, taken along line 5—5 of FIG. 2.

FIGS. 5 and 6 show the location of the alignment pins with respect to brackets 34 and 44 as well as wrench positions, etc.

While a particular embodiment of this invention has been shown, and described, it is not intended to limit the same to the exact details of the construction set forth, and it embraces such changes, modifications, and equivalence of the parts and their formation and arrangement as come within the purview of the appended claims.

What is claimed is:

1. A fastening device for releasively securing together the respective sides of first and second abutting aircraft structures, said fastening device being precisely adjustable while the structures are abutted together, comprising;

a base plate rigidly attached to said first abutting aircraft structure, said base plate supporting a latch eye bolt, said latch eye bolt being adjustable from the exterior of said first abutting aircraft structure;

a pivotable tension latch member attached to said second abutting aircraft structure for tension engagement with the eye of said latch eye bolt, when said first and second abutting aircraft structures are abutted in position and the eye of said latch eye bolt is properly positioned;

means for adjusting said latch eye bolt longitudinally, while said abutting structures are mated, said adjusting means including an adjusting nut threaded on the latch eye bolt and accessible, from the exterior of the aircraft structure through an aperture provided in said first abutting aircraft structure, to an open ended torque indicatable wrench whereby the adjusting nut may be adjusted to a predetermined torque and thereby place a predetermined tension load on the latch eye bolt and latch member; and means for locking said eye bolt in its adjusted position, said locking means including a jam nut threaded on the latch eye bolt for abutting contact with a bushing loosely interposed on the latch eye bolt between the jam nut and the adjusting nut, a spring member disposed on the latch eye bolt for applying pressure against the jam nut, the adjusting nut being adjustable to a predetermined load and the jam nut then being adjustable to overcome the pressure of the spring member and to move the bushing into tight engagement with the adjusting nut thereby locking it into place.

2. The invention as defined in claim 1, including means precisely aligning said abutting structures in their proper relative positions, said means including an extending guide member carried by one of the abutting structures, and the other abutting structure being provided with an aperture to receive in close fitting relationship said guide member to precisely align said abutting structures.

* * * * *